US007421829B2

(12) United States Patent
Gwynn

(10) Patent No.: US 7,421,829 B2
(45) Date of Patent: Sep. 9, 2008

(54) DRYWALL INSTALLATION TOOL AND METHOD

(75) Inventor: William M. Gwynn, Palmetto, FL (US)

(73) Assignee: BPB plc, Slough (GB)

( * ) Notice: Subject to any disclaimer, the term of this patent is extended or adjusted under 35 U.S.C. 154(b) by 440 days.

(21) Appl. No.: 10/927,674

(22) Filed: Aug. 27, 2004

(65) Prior Publication Data

US 2006/0053722 A1 Mar. 16, 2006

(51) Int. Cl.
*E04D 15/00* (2006.01)

(52) U.S. Cl. ..... 52/749.13; 52/730.6; 52/731.7; 52/749.1

(58) Field of Classification Search ..... 52/287.1, 52/288.1, 254, 730.3, 730.6, 731.7, 729.1, 52/749.13, 749.1, DIG. 1, 800.11, 127.1, 52/127.2, 127.5; 33/474, 481, 613, 526, 33/645; 81/44; 7/167
See application file for complete search history.

(56) References Cited

U.S. PATENT DOCUMENTS 1,016,383 A * 2/1912 Wellman ..... 81/44
1,048,333 A * 12/1912 Mishler ..... 33/481
2,911,022 A * 11/1959 Brown ..... 269/40
3,738,690 A * 6/1973 White ..... 403/4
3,904,380 A * 9/1975 Smith ..... 428/582
4,158,455 A 6/1979 Brown
4,254,945 A 3/1981 Paulson et al.
4,443,950 A * 4/1984 Cockeram ..... 33/628
4,584,775 A * 4/1986 Boman ..... 83/821
4,709,460 A * 12/1987 Luhowyj ..... 29/271
4,930,225 A * 6/1990 Phillips ..... 33/526
D317,575 S * 6/1991 Ramsey ..... D10/71
5,407,183 A 4/1995 Singeltary
D362,812 S * 10/1995 Meyer ..... D10/64
5,524,410 A * 6/1996 Menchetti ..... 52/729.2
5,658,113 A 8/1997 Lazo
5,794,998 A 8/1998 Lapierre
5,855,073 A * 1/1999 Boelling ..... 33/533
5,884,447 A 3/1999 Earp
6,131,361 A 10/2000 Murphy
6,161,824 A 12/2000 Gustavson
6,185,824 B1 * 2/2001 McClure et al. ..... 30/229
6,230,469 B1 * 5/2001 Santa Cruz et al. ..... 52/745.2
6,272,758 B1 * 8/2001 Wheeler ..... 33/1 G
6,292,997 B1 * 9/2001 Ollendick et al. ..... 29/464
6,293,058 B1 9/2001 Sink
6,327,786 B1 * 12/2001 Felix ..... 33/474
6,364,303 B1 4/2002 Gustavson
6,412,185 B1 * 7/2002 Mills et al. ..... 33/526
6,420,014 B1 * 7/2002 Hartman ..... 428/156
6,430,888 B1 * 8/2002 Dombchik et al. ..... 52/653.1
6,467,236 B1 10/2002 Schlegel
6,523,272 B1 * 2/2003 Morales ..... 33/526

(Continued)

*Primary Examiner*—Basil Katcheves
(74) *Attorney, Agent, or Firm*—Vangelis Economou; IPHorgan, Ltd.

(57) ABSTRACT

A drywall panel installation tool provides engagement for the trailing edge of a drywall panel that is being installed having an internal or external radius curved surface. The tool may include a first flat plate having apertures therein for insertion of the fasteners, a second surface extending from a longitudinal edge of the flat plate and a flange or lip for engaging an edge of the drywall panel, the flange extending from a second longitudinal edge of the flat plate in a direction opposite to that of the extension of the first surface.

12 Claims, 3 Drawing Sheets

U.S. PATENT DOCUMENTS

| | | | | |
|---|---|---|---|---|
| 6,578,279 | B1 * | 6/2003 | Moon | 33/481 |
| 6,615,564 | B2 * | 9/2003 | Lutrario et al. | 52/765 |
| 6,622,394 | B2 * | 9/2003 | Werner et al. | 33/474 |
| 6,757,983 | B1 * | 7/2004 | Moon | 33/481 |
| 6,886,268 | B1 * | 5/2005 | Morse | 33/647 |
| 6,904,732 | B1 * | 6/2005 | Richmond | 52/749.1 |
| 6,918,187 | B2 * | 7/2005 | Schaefer | 33/365 |
| 6,964,111 | B1 * | 11/2005 | Duffield | 33/478 |
| 7,316,078 | B2 * | 1/2008 | Hagman | 33/613 |
| 2001/0029673 | A1 * | 10/2001 | Brown et al. | 30/293 |
| 2003/0070310 | A1 * | 4/2003 | Werner et al. | 33/474 |
| 2005/0055978 | A1 * | 3/2005 | Visser | 52/749.1 |
| 2005/0102965 | A1 * | 5/2005 | Alfis, III | 52/749.1 |
| 2006/0174504 | A1 * | 8/2006 | Szumer et al. | 33/613 |
| 2006/0265895 | A1 * | 11/2006 | Daugherty | 33/613 |
| 2008/0053036 | A1 * | 3/2008 | Graham | 52/749.1 |

* cited by examiner

DRYWALL INSTALLATION TOOL AND METHOD

FIELD OF THE INVENTION

The present application relates to a drywall panel installation tool and specifically to a drywall installation tool for installing drywall so as to form a curved wall surface or a curved ceiling surface and to a method for attaching a drywall panel to form a curved wall surface or a curved ceiling surface.

BACKGROUND OF THE INVENTION

Drywall, otherwise known as wallboard, gypsum board or sheetrock, has long been used as an established construction material as an alternative to plaster walls or ceilings.

Modern architecture often incorporates curved wall or ceiling surfaces. Such surfaces may be either convex or concave curves and may be formed as an arc or a surface having a defined radius, either internal or external.

Drywall panels typically come in 4 foot by 8-foot sheets, and sometimes 4 foot by 12-foot sheets. These sheets are large, heavy and cumbersome.

Typically when constructing a curved wall surface, studs are put in place on 16 inch centers and the drywall panel is then thoroughly wetted and once wetted is placed against a first stud with its long edges extending horizontally and its short edges vertically and then fastened to that first stud. The panel is then serially forced against the remaining studs and fastened to each sequentially, until the last, or trailing, stud, is reached.

Because the flexibility of the panel decreases as one approaches the last stud forming the curved surface, it becomes very difficult to fasten the drywall panel to the last few studs. This is usually done by manually forcing the panel against the last stud and then applying fasteners. Frequently in this operation, because of its lack of flexibility, the drywall panel will crack, which is very undesirable because this will result in a discontinuity in the curved surface which must then be corrected by extensive sanding and patching with joint compound. Another problem is that the fasteners attaching the drywall panel to the last stud may pull through the panel as a result of the tension created by the curved panel. Installation of a drywall panel to a curved surface in this manner typically requires two or more people, one or more who attempt to maintain a flush relationship between the panel surface and the studs and another who performs the fastening operation. If the surface is a concave surface having an internal radius, three or more people may be required.

U.S. Pat. No. 4,709,460 to Luhowyj describes and illustrates a tool and method of using the tool to support and guide panels so that they may be easily and safely placed for installation. The tool is attached to an edge of an adjacent panel by fastening it by, for example, a drywall nail. The panel is then provided a guide to be joined in an abutting relationship, and is then fastened to the underlying frame. This method, when using two or more of these tools described, is useful especially for installation of panels on a ceiling. No provision is made for curved surfaces.

U.S. Pat. No. 4,158,455 to Brown and U.S. Pat. No. 4,658,113 to Lazo describe and illustrate a wall panel installation jig for holding the panels during installation so as to enable installation by a single installer. Use of the jig requires its temporary attachment by nails or the like to the wall studs to restrain the panel while it is installed, and subsequent removal of the jig for use on adjacent panels. Lazo further includes integral levelers and provides guides or slots for indicating where the fasteners should be inserted in corresponding relationship with the studs.

U.S. Pat. No. 5,254,945 describes a similar installation tool having the advantage of being easily removable, that is without removing the fasteners, after the wall panel has been fastened to the framing members.

One object of the present invention is to provide a tool for assisting in installation of drywall panels to form a curved surface, which reduces the manual effort required and which overcomes the problems noted above.

The present invention provides a drywall installation tool comprising an elongated plate having one straight edge adapted to be placed adjacent the edge of a sheet or panel of drywall, a series of holes in the elongated plate being spaced approximately equally from said straight edge, whereby when the flat plate is placed against a drywall panel with the straight edge thereof aligned with the edge of the drywall panel, fasteners may be inserted through the holes in the plate to attach the drywall panel to an underlying framework of spaced studs.

The present invention also provides a method of attaching a drywall panel to a series of studs or rafters aligned in a curve on 16 inch centers comprising attaching one edge of the drywall panel to a first stud or rafter of the series of studs or rafters, attaching the drywall sheet serially to each of the next studs or rafters until all but two or three of the studs or rafters of the series of studs or rafters remain unattached to the drywall panel, using the inventive drywall installation tool to push and retain the drywall panel against the remaining two or three unattached studs or rafters, and fastening the drywall panel to the last two or three studs or rafters with the last stud or rafter being attached to the drywall panel by inserting fasteners through the holes in the drywall installation tool provided for this purpose.

BRIEF DESCRIPTION OF THE DRAWINGS

This invention will be better understood as set forth in the following description, with reference to the drawings, in which.

DETAILED DESCRIPTION OF THE PREFERRED EMBODIMENT

Figure 1:
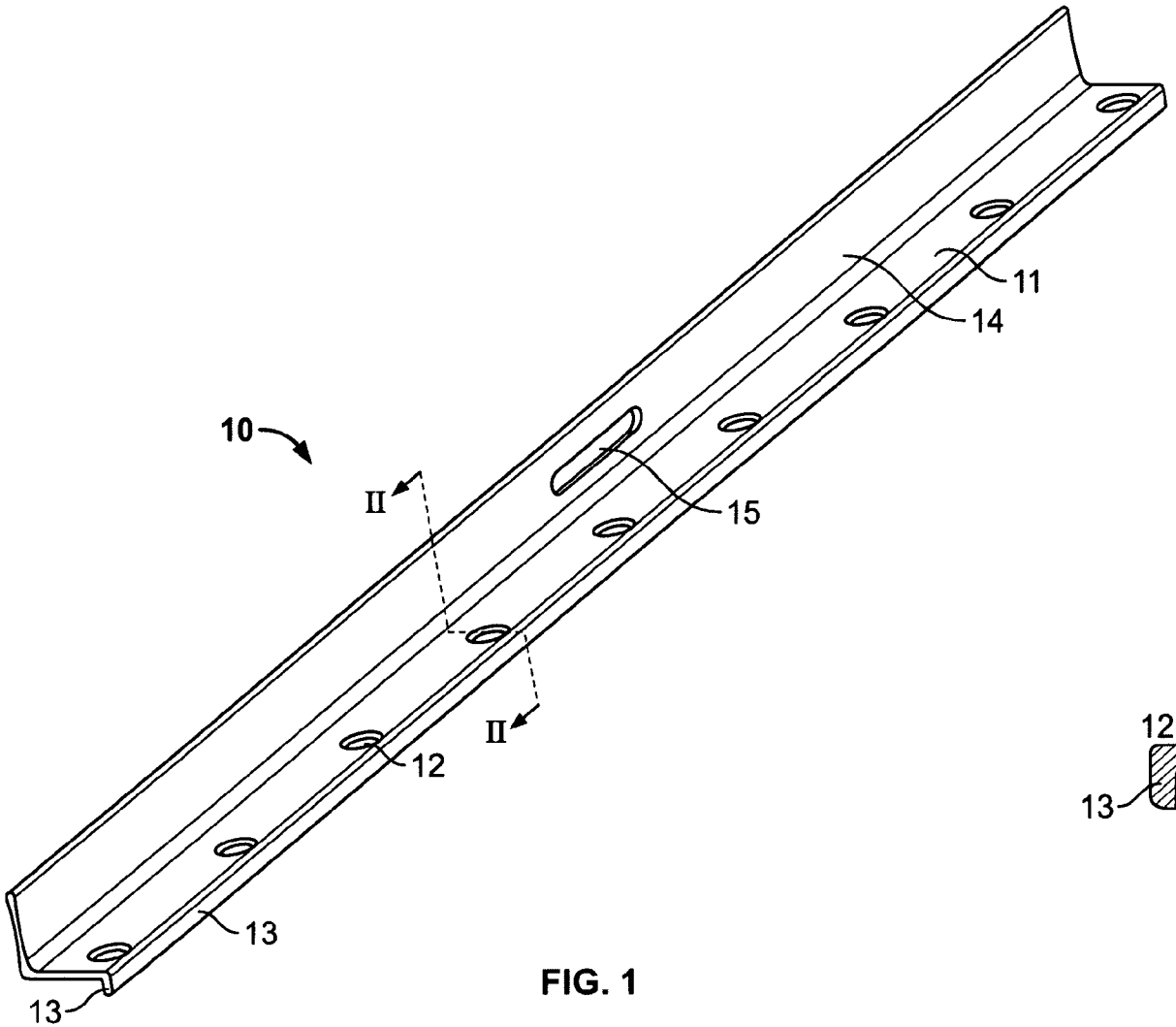
FIG. 1 is a perspective view of the drywall installation tool of the present invention.

Referring now to FIG. 1, the drywall installation tool 10 of the present invention is illustrated. The tool 10 is formed of a flat plate 11 having a series of spaced holes 12 therein. A flange 13 extends essentially at a 90° angle from one side of the plate 11 for the purpose of abutting against an edge of the drywall panel when the tool is being used, thus locating the holes 12 with respect to the edge of the panel during installation.

From the other side of the flat plate 11, a surface 14 extends in the opposite direction. The surface 14 serves to rigidify the plate 11 and may provide an integral handle, such as the slot 15 shown in FIG. 1, for ease in manipulation of tool 10. Of course, other forms of handles may be formed on the surface 14 or on the plate 11 or maybe attached thereto. The holes in the plate 11 are preferably ¾ inch diameter holes and are located approximately 5.75 inches apart with the two end holes each being located approximately one inch from the longitudinal end of the flat plate 11.

Figure 5:
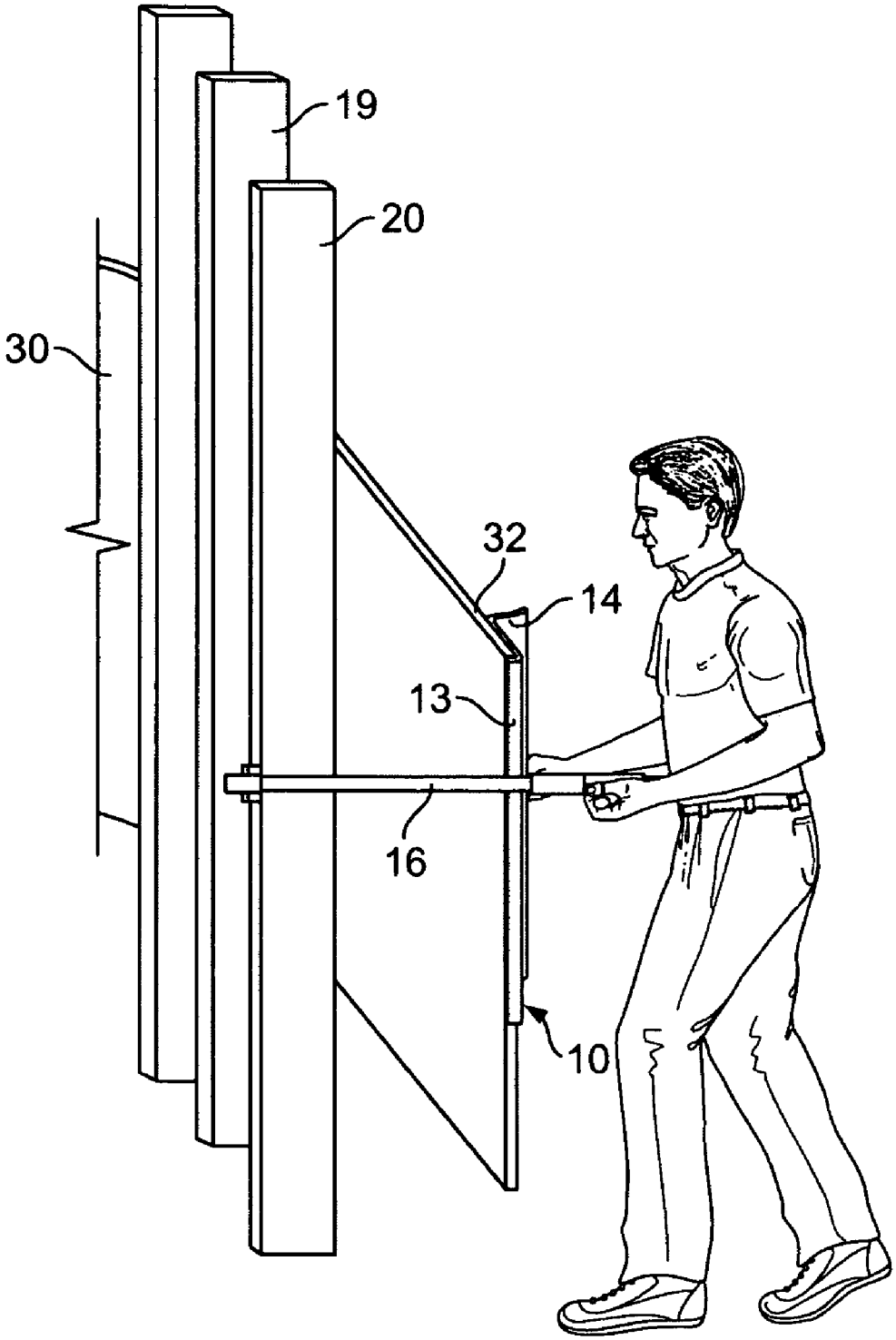
FIG. 5 is a side elevational view of FIG. 3.

Preferably the tool has a length corresponding to the width of the gypsum board panel, usually four feet, so as to span the full width of the panel edge and thereby provide a bending force as to the full width of the edge. However, the length of the drywall installation tool 10 may be varied depending on requirements; for example, it may be shorter to avoid excessive weight, as shown in FIG. 5.

The drywall installation tool 10 is preferably made of aluminum. Preferably the flat plate 11, flange 13, and surface 14 are integrally formed, but they could be formed separately and attached to each other by welding or other means. Preferably the surface 14 has opposite outwardly concave surfaces shown at 15*a* and 15*b* in FIGS. 2 and 4 to provide for further weight reduction.

Figure 4:
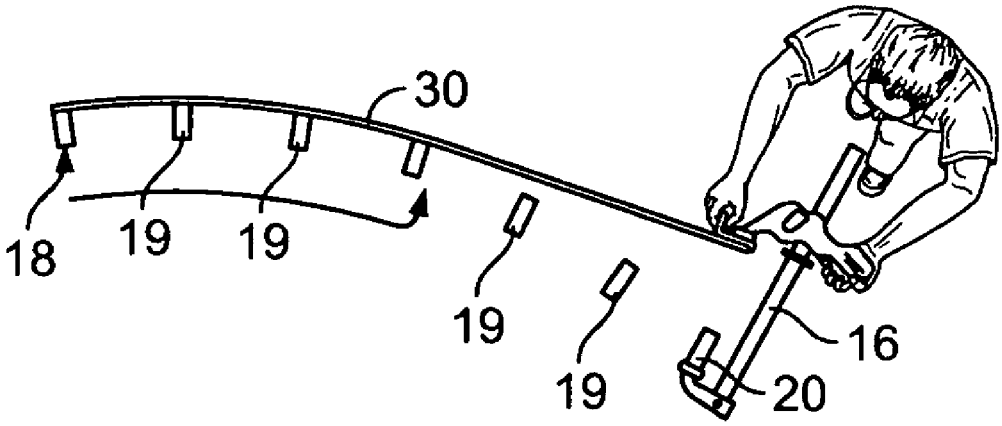
FIG. 4 is a cross-sectional view of the tool and panel shown in FIG. 3, shown in greater detail.

As shown in the detail view in FIG. 4, the cross-sectional detail view of the installation tool 10 is shown in the process of attaching the trailing edge 32 of a drywall panel to the last or trailing stud 20. The configuration and right angle orientation of the flat plate 11, relative to the flange or lip 13, permits the secure retention and contact of the drywall panel edge 32 with two surfaces of tool 10. The rigid nature of the aluminum construction of the tool 10 permits the user to temporarily attach the drywall panel edge to the trailing edge stud 20 by means of clamps 16. The tool 10 permits the drywall panel surface to become flush with the surface of all the studs 20, leaving no slack, and thereby ensuring vertical alignment of the trailing edge of the drywall panel in relation to the trailing vertically disposed stud 20 (FIG. 5).

Figure 2:
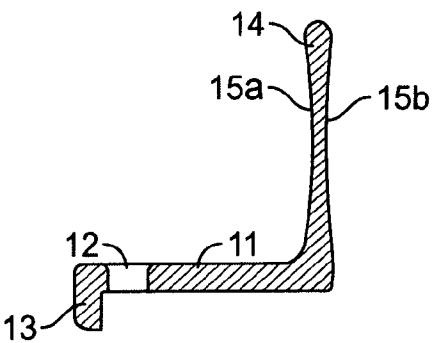
FIG. 2 is a cross-sectional view taken approximately along line II-II of FIG. 1.

As shown in the cross-sectional view of FIG. 2, the construction of the tool 10 is intended to provide the optimum balance between reducing the weight thereof as much as possible, so that manipulation by a single user is facilitated, consistent with maintaining the rigidity of the tool, so that it can perform its function of retaining the trailing edge of the drywall panel flush with the last stud 20.

Figure 3:
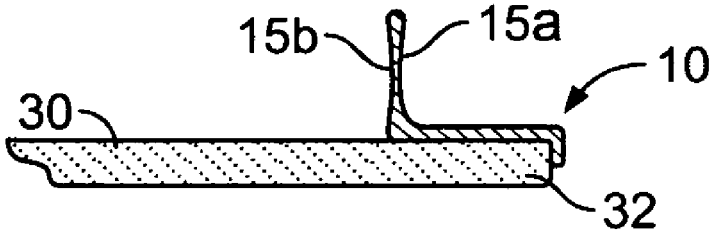
FIG. 3 is a top plan view of a drywall panel tool being applied to form an external radius curved surface.

In the method according to the present invention of using the tool, wall studs or ceiling rafters are set at 16-inch centers. The drywall panel is then placed with one end edge in contact with a first or leading stud 18 and the panel is then attached to stud 18 with a series of fasteners inserted at the distal edge of the panel. The drywall panel is then forced into contact with a second or intermediate stud 19 next to the first stud 18 and is attached to the second stud 19 with a series of fasteners. This process continues for fastening to the intermediate studs 19 until the drywall panel has been attached to all but the last one or two intermediate studs 19 and the last stud 20 as shown in FIGS. 3 and 5.

At this time, the drywall installation tool 10 is used to retain the edge 32 of the drywall panel 30 against the last stud 20. One or more clamping devices, such as a bar clamp 16, may be used to clamp the installation tool and drywall panel 30 to the last stud. Preferably clamps are used at the top and bottom of the drywall panel 30, but the clamp ends come into contact only with the stud 20 and the flat plate 11 of the drywall panel installation tool 10, so as to avoid damage to the edge 32 of drywall panel 30. Fasteners are then applied to attach the drywall panel 30 to the last two or three studs 19, 20, with the fasteners attaching the drywall panel to the last stud 20 being applied through the holes 12 disposed in the drywall installation tool 10 adjacent the edge 32.

The drywall installation tool 10 shown in FIG. 5 has a length somewhat shorter than the full width of the panel, taking into consideration the need to reduce weight, for example. However, requirements for a uniform bending of the radius or other considerations may require a length greater than the panel width.

The installation tool provides the benefit of avoiding improper installation, so as to avoid fastener pull through, edge core fissures and fracturing, and possible improper alignment of the edge 32 of a panel 20 relative to the final stud 20. Using the installation tool 10 in accordance with the present invention essentially eliminates such problems in that the load applied to the trailing edge 32 of the drywall panel 30 is even across a major portion of the width of the panel, and thus eliminates stresses that are forced on the edge of a panel as the fasteners are applied. Moreover, use of the tool permits a single user, when provided with appropriate tools, to install the panels on a curved surface efficiently, and without requiring assistants to hold down the edge of a panel during the installation process. The curved surface can thus be created by one laborer without requiring pre-soaking of a board manufactured from appropriate materials, that is flexible enough to withstand bending or curving so as to enable installation without cracking of the drywall panel, for example, of a board of the type described in commonly owned U.S. Pat. No. 6,524,679, or such boards manufactured by Certain Teed Gypsum, Inc., of Tampa, Fla., in accordance with the teachings therein, and available under the name GlasRoc®.

For installation of an internal radius curved surface, the installation procedure is essentially the same except that force must be applied to the panel edge both in the normal direction, that is in the direction toward the stud, but also in the direction of the curve, so as to maintain flush contact between the studs and the adjacent surface of the drywall panel. To facilitate the concave curvature of an internal radius curved wall or ceiling surface, it may be necessary to depress the center section of the panel toward the frame of studs before applying the longitudinal force against the panel edge. Thus, when a longitudinal pressure force is applied by the installation tool, the drywall panel is more apt to bend to conform with the configuration of the frame defined by the studs.

When the curved surface is a ceiling surface, the procedure is also essentially the same. Ceiling rafters are set at 16-inch centers with their outer edges defining a curve. The drywall is then fastened to a first rafter and subsequently to an adjacent rafter and so on until the drywall panel is attached to all but the last two or three rafters. The installation tool is then used to bring the board into contact with the last two or three rafters and the fasteners are applied, much as on a frame of vertically aligned studs as described above.

Although the preferable material has been described above as comprising aluminum, so as to maintain costs to a reasonable level, while reducing the weight of the tool 10 as much as possible, other materials may also be used. Any appropriate metal alloy or even composite material is a good candidate for fabrication of tool 10, as long as it will resist longitudinal flexing and undue wear, that is, any material that is lightweight and rigid enough to meet the above described considerations. The surface of the tool 10 may also be finished by an appropriate means, such as powder coating, anodizing, etching, texturing or a combination of these. Scoring at regular intervals along the edge may also provide the secondary function of a length-measuring device, such as a ruler.

Other appropriate modifications are also contemplated, for example the length of the tool 10 may be varied to meet the expected widths of the drywall panels for which its use is intended. Similarly, appropriate spacing intervals between adjacent apertures or the diameters or number thereof, has been set forth above, but more appropriate intervals and characteristics may also be used for varying purposes, as desired.

Other modifications, alterations or variants may be utilized by those having ordinary skill, for example, by utilizing some other retention mechanism other than a bar clamp, as described above, to retain the inventive drywall panel installation tool against the edge of a dry wall panel, without deporting from the scope of the present invention. Thus, the above embodiments are to be considered as being illustrative only, the invention being limited only by the following claims.

What is claimed is:

1. A drywall panel installation tool comprising an elongated plate having one straight edge adapted to be placed adjacent the edge of a drywall panel a series of holes being disposed in said elongated plate and being spaced approximately equally from said straight edge, and the tool including a perpendicular second plate extending from an edge of said elongated plate, the second plate having a slot providing a handle therein, whereby when said elongated plate is placed against a drywall panel with the straight edge thereof aligned with the edge of the drywall panel, said holes being shaped and configured to permit fasteners to be inserted completely through the holes in the plate, thereby to attach only the drywall panel by positioning the point of penetration of the fastener to correspond with a stud underlying the drywall panel, and said slot handle being disposed for enabling the removal of the installation tool after insertion of the fasteners into the gypsum.

2. The drywall panel installation tool of claim 1, wherein a lip extends from said straight edge of said elongated plate for locating said plate and said holes with respect to the edge of the drywall panel, said lip having a width that is less than the thickness of the drywall panel being installed.

3. The drywall panel installation tool of claim 2, wherein a second plate extends from an edge of said elongated plate opposite said straight edge in a direction opposite the direction that said lip extends from said straight edge.

4. The drywall panel installation tool of claim 3, wherein a handle is formed on said second plate.

5. A drywall panel installation tool comprising an elongated plate having one straight edge adapted to be placed adjacent the edge of a drywall panel, a series of holes being disposed in said elongated plate and being spaced approximately equally from said straight edge, whereby when said elongated plate is placed against a drywall panel with the straight edge thereof aligned with the edge of the drywall panel, said holes being shaped and configured to permit fasteners to be inserted completely through the holes in the plate, thereby to attach only the drywall panel by positioning the point of penetration of the fastener to correspond with a stud underlying the drywall panel, wherein a lip extends from said straight edge of said elongated plate for locating said plate and said holes with respect to the edge of the drywall panel, said lip having a width that is less than the thickness of the drywall panel being installed, and a second plate extends from an edge of said elongated plate opposite said straight edge in an essentially perpendicular angle direction opposite the direction that said lip extends from said straight edge, wherein a handle is formed in said second plate in the form of a slot.

6. The drywall panel installation tool of claim 5, wherein the centers of said holes are spaced approximately one inch from the straight edge of said elongated plate.

7. The drywall panel installation tool of claim 6, wherein said tool is formed of aluminum.

8. The drywall panel installation tool of claim 6 wherein the plurality of holes have a diameter to permit the fasteners that will be used to attach the drywall panel to pass through the holes and to attach the drywall panel to the underlying stud so that the fasteners retain only the drywall attached to the studs.

9. The drywall panel installation tool of claim 8 wherein the predetermined diameter of the apertures is about ¾ inch.

10. The drywall panel installation tool of claim 5, wherein said elongated and second plates are integral.

11. The drywall panel installation tool of claim 5 wherein the plurality of holes in the elongated plate are each about ¾ inch in diameter.

12. A drywall panel installation tool of comprising an elongated plate having a first straight edge adapted to be placed adjacent the edge of a panel of drywall panel, a series of holes being disposed in said elongated plate spaced approximately equally from said straight edge, a lip extending from said first straight edge for orienting and locating said elongated plate and said holes with respect to the edge of the drywall panel whereby when said elongated plate is placed against a drywall panel with the straight edge thereof aligned with the edge of the drywall panel, fasteners may be inserted through the holes in the plate to attach the drywall panel to an underlying stud, the tool further comprising a second plate extending from a second edge of said elongated plate, disposed opposite said first straight edge and extending in a direction opposite the direction that said lip extends from said straight edge, wherein said second plate includes opposite outwardly concave surfaces.

* * * * *